US007775920B1

(12) United States Patent
Kuchcinski et al.

(10) Patent No.: US 7,775,920 B1
(45) Date of Patent: Aug. 17, 2010

(54) ELASTOMERIC PITCHING SHOE

(76) Inventors: Daniel P Kuchcinski, 7550 Buckingham Pl., Fairview, PA (US) 16415; Dale R Pierce, 7423 W. Ridge Rd., Fairview, PA (US) 16415

( * ) Notice: Subject to any disclaimer, the term of this patent is extended or adjusted under 35 U.S.C. 154(b) by 114 days.

(21) Appl. No.: 11/906,847

(22) Filed: Oct. 3, 2007

(51) Int. Cl.
*A63B 65/00* (2006.01)

(52) U.S. Cl. ..... 473/591

(58) Field of Classification Search ..... 473/591, 473/600–603, 125, 126; 59/900; 168/4, 168/12, DIG. 1
See application file for complete search history.

(56) References Cited

U.S. PATENT DOCUMENTS 2,219,972 A * 10/1940 Altendorf ..... 473/591
3,513,915 A * 5/1970 Sherman ..... 168/4
3,603,402 A * 9/1971 McDonnell ..... 168/4
3,740,354 A * 6/1973 Dearmont ..... 473/125
4,265,454 A * 5/1981 Bayless ..... 473/591
4,880,242 A * 11/1989 White ..... 473/591
4,927,159 A * 5/1990 Morrissey et al. ..... 473/591
4,957,168 A * 9/1990 Battista ..... 168/4
5,222,561 A * 6/1993 Fisher et al. ..... 168/12
RE34,614 E * 5/1994 Gentiluomo ..... 473/126
5,317,489 A * 5/1994 Delli Gatti et al. ..... 473/591
5,342,043 A * 8/1994 Baltronis et al. ..... 473/599
5,704,857 A * 1/1998 Davenport ..... 473/591
7,409,818 B2 * 8/2008 Llewellyn ..... 168/DIG. 1
2005/0034877 A1 * 2/2005 Bergeleen ..... 168/6

OTHER PUBLICATIONS http://www.molders.com/rubber_engineering_guide.html; "Characteristics of Rubber Compounds", retrieved Apr. 16, 2009.*

* cited by examiner

*Primary Examiner*—Steven Wong
(74) *Attorney, Agent, or Firm*—Richard K Thomson

(57) ABSTRACT

A pitching shoe configured to have a size, shape, and weight of a conventional metallic shoe is made of elastomers having specific gravities in the range between 1.8 and 2.0 to enable reintroduction of the sport to correctional facilities and other applications where metallic shoes create too great a risk of injury. Suitable materials include neoprene, natural rubber, SBR, natural/SBR blend, or other natural or synthetic rubbers and rubber blends, and plastics which include high density fillers compounded into or mixed with a base plastic material.

4 Claims, 1 Drawing Sheet

ELASTOMERIC PITCHING SHOE

BACKGROUND AND SUMMARY OF THE INVENTION

The present invention is directed to the field of horseshoes. More particularly, the present invention is directed to a pitching shoe with conventional size, shape and weight which is made of conventional or man-made rubber or blends of the two.

Horseshoe pitching is a popular past time which is centuries old, finding its roots in an ancient Grecian game called "Quoits". Rubber shoes have been made to introduce children to the sport and, typically, have a curved shape similar to a pitching shoe but do not have a similar weight, nor do they have the traditional shape (toe cleats nor grip cleat) of a standard pitching shoe.

Horseshoe pitching with conventional metal shoes is virtually banned from all state correctional institutions for the obvious reason that a metallic shoe also makes an excellent weapon. The present invention provides an elastomeric shoe of conventional or man-made rubber or blends thereof, which have conventional size, weight and shape to enable shoe pitching to be re-introduced into correctional facilities. The preferred formulation used to produce the pitching shoe of the present invention comprises high density rubber, plastics, or other polymer compounds with specific gravity exceeding 1.9 including, but not limited to: neoprene, natural rubber, SBR, natural/SBR blend, or other natural or synthetic rubbers and rubber blends, and plastics which include high density fillers compounded into or mixed with the base plastic material. The resulting shoe will weigh between 1.5 and 2.0 pounds and have the same general feel of a conventional metal pitching shoe.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 2:
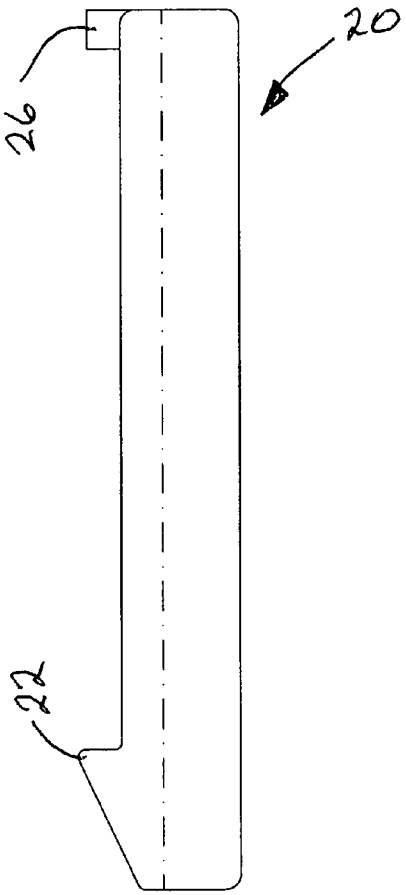
Figure 1:
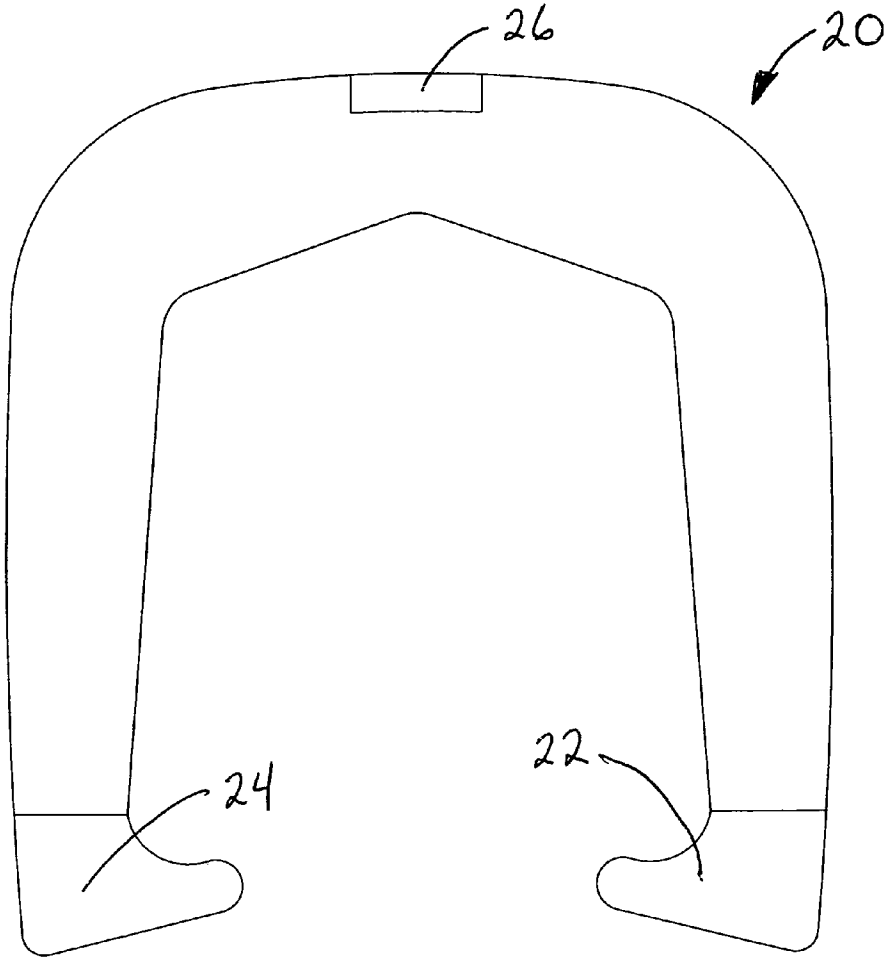
FIG. 1 is a front view of a first embodiment of the pitching shoe of the present invention; and, FIG. 2 is a side view of the first embodiment.

A first preferred embodiment of the pitching shoe of the present invention is shown generally at 20 in FIGS. 1 and 2. There is nothing particularly novel about the configuration of shoe 20. In fact, it is desired that the pitching shoe of the present invention take on the form of a conventional metallic shoe, having a similar size, shape, and weight so that they feel like standard pitching shoes. Therefore, shoe 20 a pair of toe cleats 22, 24 and a grip cleat 26.

The novelty of the present shoe 20 is in the selection of the materials, being made of an homogenous elastomer having a specific gravity of between 1.8 and 2.0, most preferably 1.9. Shoe 20 will, therefore, based on the chosen size, weigh in the range of between 1.5 and 2.0 pounds, consistent with the weights of most conventional metallic shoes. Materials suitable for manufacture of this shoe include high density rubber, plastics, or other polymer compounds with specific gravity in the specified range. More particularly, the material is selected from the group consisting of neoprene, natural rubber, SBR, natural/SBR or other natural or synthetic rubbers and rubber blends, and plastics which include high density fillers compounded into or mixed with a base plastic material.

By providing a pitching shoe with the look and feel of a conventional metallic horseshoe, the present invention enables the time-honored sport of pitching horseshoes to be reintroduced to correctional institutions without the risks associated with one of the metallic shoes being used as a weapon. The shoes may also find favor with Special Olympics participants and others for whom metallic shoes create too great a risk of injury. The horseshoes of the present invention may also become popular with anyone who has had a "shin encounter" with a metallic shoe which galloped into them like the horse was still attached.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

We claim:

1. A unitary regulation pitching shoe having a horseshoe shape with two inwardly directed toe cleats and an orthogonally directed gripping cleat, said pitching shoe consisting of a homogenous mass of formulated elastomer having a weight of between 1.5 and 2.0 pounds said elastomer having a specific gravity in a range between 1.8 and 2.0.

2. The pitching shoe of claim 1 wherein said formulated elastomer comprises a material selected from the group including high density rubber, plastic, polymer compounds, and blends thereof, said formulated elastomer including high density fillers.

3. The pitching shoe of claim 2 wherein said formulated elastomer most preferably has a specific gravity of 1.9.

4. The pitching shoe of claim 3 wherein said formulated elastomer is selected from a group consisting of neoprene, natural rubber, SBR, natural/SBR blend, or other natural or synthetic rubbers and rubber blends, and plastics, which include high density fillers compounded into or mixed with a base elastomer material.

* * * * *